US008864087B2

(12) United States Patent
Goldin et al.

(10) Patent No.: US 8,864,087 B2
(45) Date of Patent: Oct. 21, 2014

(54) ADJUSTABLE FURNITURE ATTACHMENT CLAMP

(76) Inventors: Michael Goldin, Berkeley, CA (US); Steven Goldin, Berkeley, CA (US)

( * ) Notice: Subject to any disclaimer, the term of this patent is extended or adjusted under 35 U.S.C. 154(b) by 250 days.

(21) Appl. No.: 13/584,703

(22) Filed: Aug. 13, 2012

(65) Prior Publication Data

US 2013/0037667 A1 Feb. 14, 2013

Related U.S. Application Data

(60) Provisional application No. 61/523,182, filed on Aug. 12, 2011.

(51) Int. Cl.
*A47B 96/00* (2006.01)
*A47B 13/00* (2006.01)

(52) U.S. Cl.
CPC ..... *A47B 13/003* (2013.01)
USPC ..... 248/222.14; 348/223.41; 312/349

(58) Field of Classification Search
USPC ..... 248/222.14, 223.41, 228.1, 295.11, 248/298.1; 312/349, 350
See application file for complete search history.

(56) References Cited

U.S. PATENT DOCUMENTS

| | | | | | |
|---|---|---|---|---|---|
| 1,700,120 | A | * | 1/1929 | Campbell | 248/300 |
| 2,694,543 | A | * | 11/1954 | Norris | 248/476 |
| 3,888,445 | A | * | 6/1975 | Pence | 403/189 |
| 4,244,546 | A | * | 1/1981 | Mertes et al. | 248/258 |

* cited by examiner

*Primary Examiner* — Gwendolyn W Baxter
(74) *Attorney, Agent, or Firm* — Brian Beverly; Beeson Skinner Beverly, LLP

(57) ABSTRACT

An adjustable furniture attachment clamp for attachment to the underside of a furniture item with two spaced apart arm fasteners, the clamp comprising a clamp body having oppositely disposed laterally extending forked arms, each arm having a fastener slot having a width greater than the shanks of the arm fasteners, the fastener slots including inner ends spaced apart a distance less than the arm fasteners, such that lateral and forward-to-back play is provided for adjustment of the clamp relative to the furniture item, the clamp also having a downwardly facing beam pocket including a beam capture surface for holding the right upper beam flange of a support I-beam and a cam having a binding face for pressing against the lower portion of the left upper beam flange when a cam fastener is tightened for attaching the clamp body to the I-beam.

11 Claims, 5 Drawing Sheets

ADJUSTABLE FURNITURE ATTACHMENT CLAMP

CROSS-REFERENCE TO RELATED APPLICATIONS

This application claims the benefit of U.S. Provisional Application No. 61/523,182 filed Aug. 12, 2011.

FIELD OF THE INVENTION

This invention relates to customizable high durability furniture and in particular to an adjustable clamp for securing items of furniture, such as a desk, table top or shelving, to wall surfaces that are out of true or in corners that are not square.

BACKGROUND

The structural components of high durability customizable furniture are manufactured from rigid materials, such as stainless steel or aluminum, according to architectural specifications. For reasonable manufacturing efficiency, many furniture items such as tables and other work surfaces are manufactured with straight sides and square edges. A strong support structure can be made for attaching the furniture item to a wall by projecting a horizontal I-beam from a wall surface, such as shown in FIG. 8, or from a free-standing structure. Although not illustrated, the nature of the means for securing the I-beam to the wall results in the beam projecting perpendicularly from the wall at the point of attachment. Corresponding attachment components on the furniture item are constructed to engage the I-beam perpendicularly such that the furniture is also secured perpendicularly to the I-beam and, thus, parallel to the wall. Therefore, it becomes critically important for the I-beam to project perpendicularly from the wall so that, when an item of furniture is attached to it, the furniture lines up in perfect parallel alignment with the wall.

In most existing construction, walls are not perfectly straight and corners are not perfectly square. Therefore, I-beams projecting from an particular attachment point on a wall may not be perfectly perpendicular to the wall. Even with perfectly straight walls, if walls which intersect to form a corner are not square, the I-beams which project from the adjoining walls will not be in perpendicular relation to each other. Misalignment problems such as these make it difficult or impossible to secure table surfaces with straight sides and square corners in optimal alignment with an adjacent support wall or to fit a table top in the optimal position in a corner that is out of square.

If, for example, an I-beam projects from a wall having a surface imperfection, the I-beam may project at an angle that is not perpendicular to the general plane of the entire wall. Therefore, if a square desk is attached to the wall using the I-beam system described above, the surface nearest the wall will not be in parallel alignment with the wall. Rather than being an insignificant problem, since people are keen observers of this type of aesthetic misalignment, the installation can be rejected.

In another example, in the case of a desk having a return, if the desk is to be attached to one wall in a corner using the I-beam system described above, and the return is to be attached in like fashion to the other wall, if the I-beams are not in perpendicular relation to each other, only the desk or the return can be attached, but not both because the desk and return will not align with each other.

In addition to the above-described misalignment situation, during installation of more than one high durability furniture item, it if desirable to have a mechanism that allows relatively fine adjustments between adjoining pieces to present an aesthetically pleasing setting.

While work around solutions can be developed to solve the above furniture installation problems, they are expensive and time consuming. Therefore, an improved attachment mechanism is needed which permits attachment of rigid straight-sided furniture items to walls which are not perfectly flat and in corners that are not square.

BRIEF DESCRIPTION OF THE ILLUSTRATIONS

DETAILED DESCRIPTION OF THE ILLUSTRATED EMBODIMENT

Figure 1:
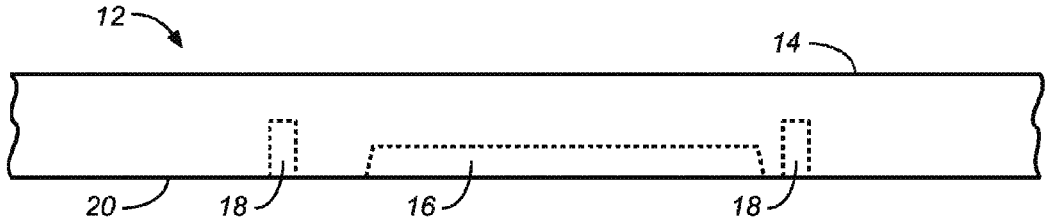
FIG. 1 is an elevational view of an item of furniture having a horizontal top surface, such as a portion of a table top, showing a clamp recess and two fastener holes.
Figure 2:
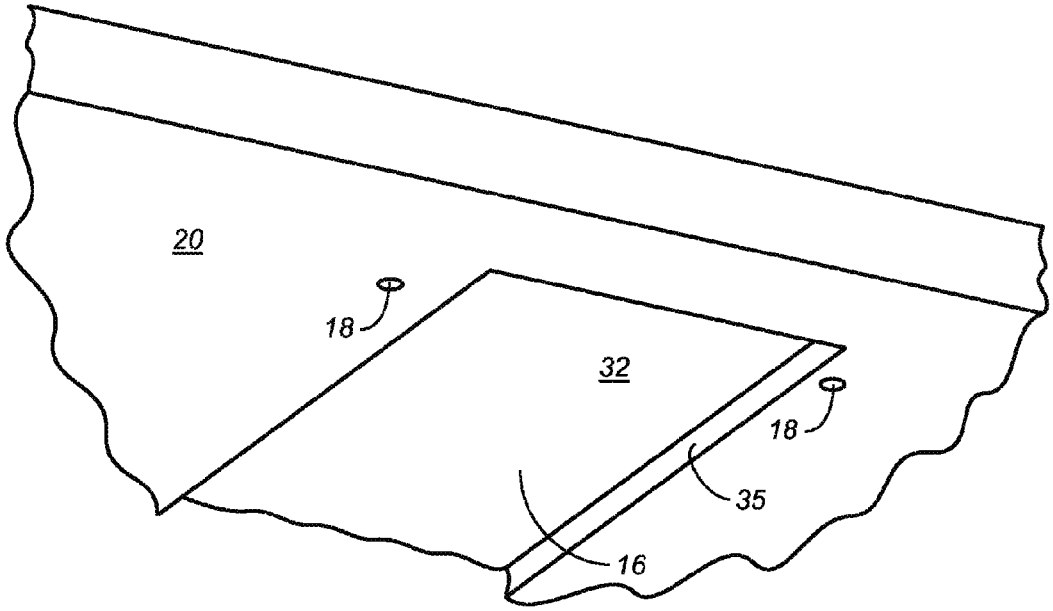
FIG. 2 is a lower perspective view of the underside of the furniture item of FIG. 1.
Figure 6:
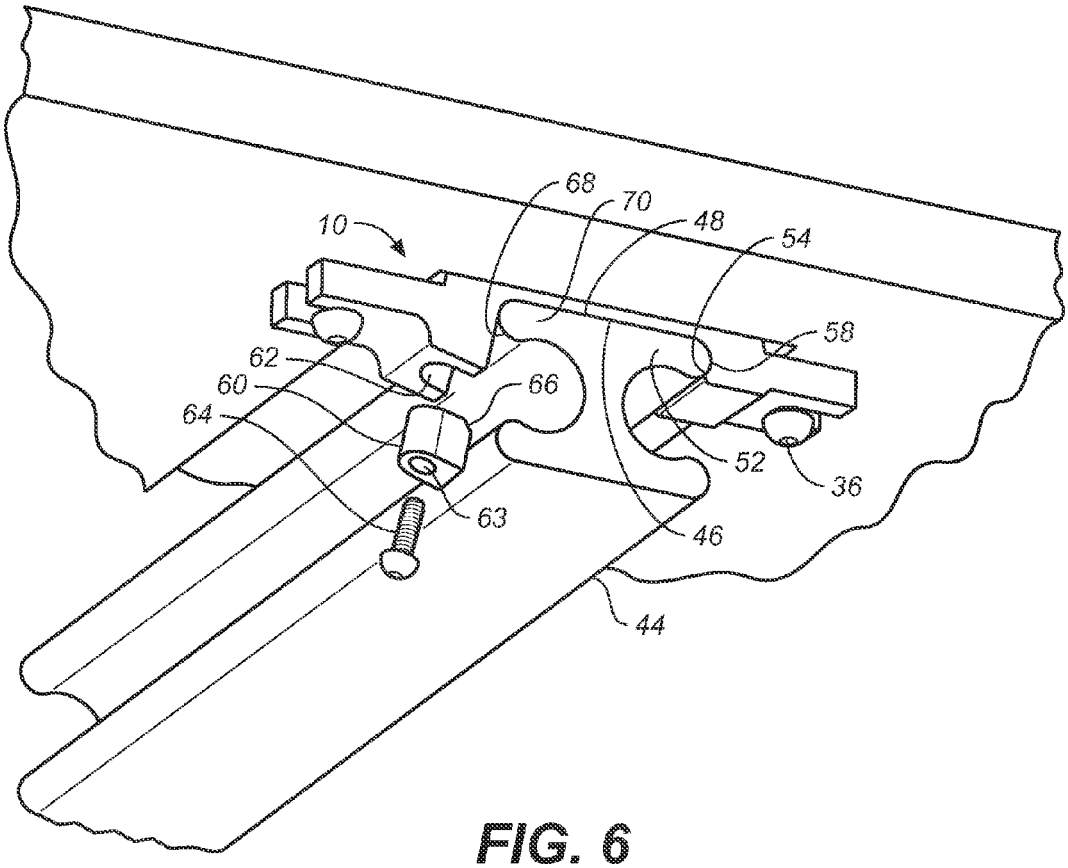
FIG. 6 is a lower perspective view of the furniture item, clamp body, arm fasteners, support I-beam, clamp cam and clamp cam fastener of FIG. 5.

An adjustable furniture attachment clamp according to the invention, referred to generally at 10 in FIG. 6, provides an improved mechanism for attaching furniture items to an adjoining wall. FIG. 1 shows a furniture item 12 having a flat top surface 14 and an underside 20. Although the adjustable furniture clamp described herein can be used for any furniture item having a horizontally disposed underside, such as a table, bookshelf, or storage cabinet, for the sake of clarity the furniture item 12 illustrated in the accompanying drawings is a table top. A clamp recess 16 and fastener holes 18 are provided on the underside 20 of the furniture item 12 as shown in FIGS. 1 and 2.

Figure 3:
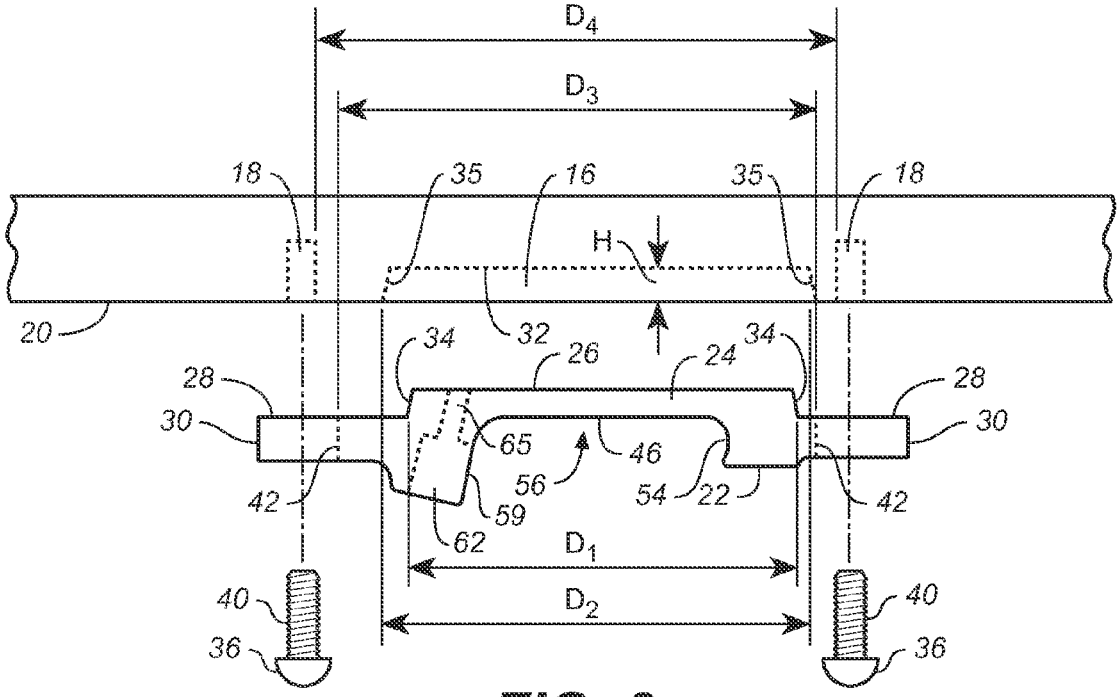
FIG. 3 is an exploded elevational view of an adjustable furniture clamp according to the invention disposed below the furniture item shown in FIG. 1.
Figure 4:
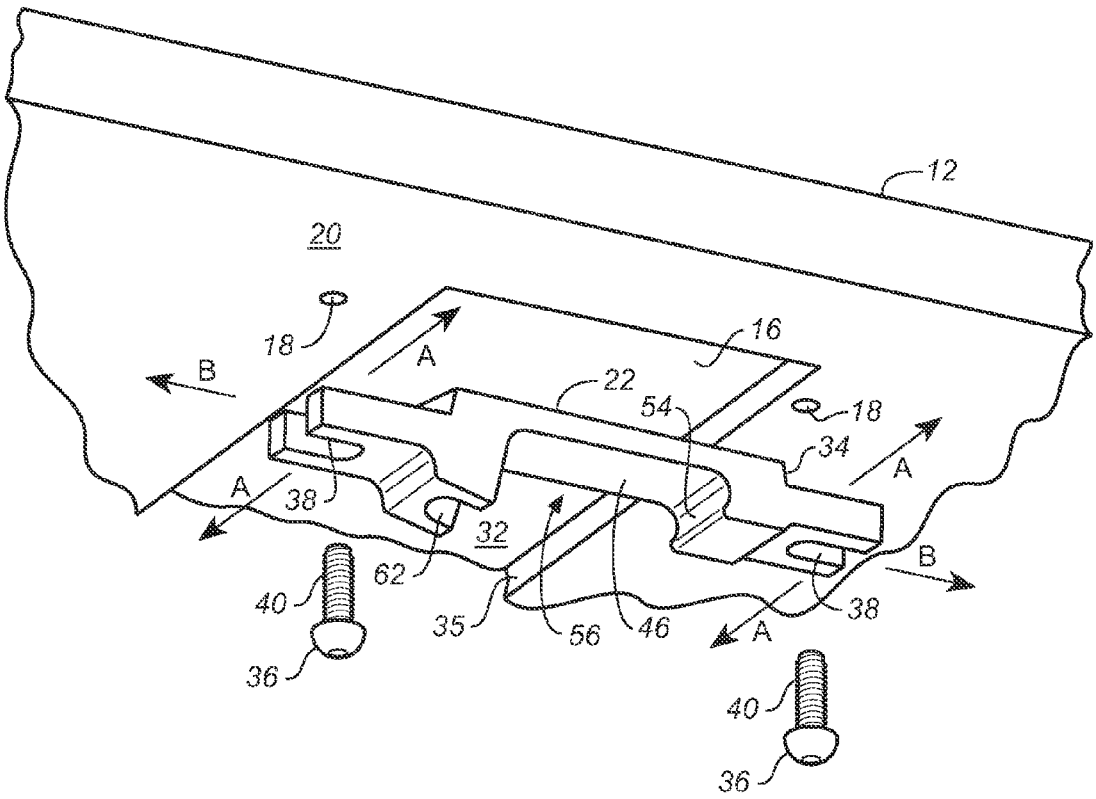
FIG. 4 is an exploded lower perspective view of the furniture clamp and furniture item shown in FIG. 3.

As shown in FIGS. 3 and 4, the adjustable furniture attachment clamp has a clamp body 22 having left and right shoulders 23L, 23R. An elevated horizontal top strut 24 extends between and connects shoulders 23L, 23R. Two forked arms 30 extend laterally from the clamp body 22. The top face 26 of the top strut 24 is in parallel planar alignment with and spaced above to the top surfaces 28 of arms 30 a distance no greater than the height H of the recess 16 as measured from the underside 20 of the furniture item 12 to the upper face 32 of the clamp recess 16. This allows the entire top strut 24 to fit within the clamp recess 16 when the arms 30 are positioned against the underside 20 of the furniture item 12 as shown in FIGS. 5-8. The top strut 24 also has two opposite side walls 34 spaced apart by a distance $D_1$ less than the distance $D_2$ between the two side edges 35 of the clamp recess 16, thereby providing room for some lateral play when the top strut 24 is positioned in the clamp recess 16. See, e.g., FIG. 6.

Figure 3A:
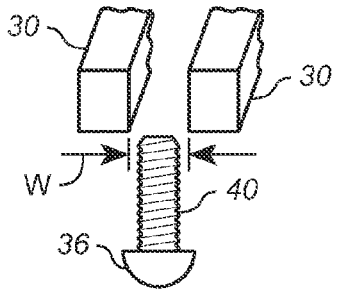
FIG. 3A is an upper perspective view of the forked end of one of the attachment arms and an arm fastener.

Once in position in the clamp recess 16, the clamp body 22 is loosely held in place by inserting arm fasteners 36 through fastener slots 38 in each of the arms 30 and partially tightening them in fastener holes 18 in the underside 20 of the furniture item 12. A measure of forward-to-back play in clamp body 22 is provided because the width W of the fastener slots 38 is larger than the width of the shanks 40 of each arm fastener 36. See FIG. 3A. Lateral play is provided because the fastener slot separation distance $D_3$ between the innermost edges 42 of slots 38 is less than the arm fastener holes separation distance $D_4$ between the shanks 40 of the arm fasteners 36 when the latter are resident in the arm fastener holes 18, as indicated in FIG. 3. Play is thus provided in two directions, forward-and-back, as indicated by arrows A in FIG. 4, and laterally, as indicated by arrows B in FIG. 4, to permit fine adjustments in the position of the clamp body 22 while held loosely in position against the underside 20 of the furniture item 12. In one embodiment of the invention lateral play of +/−¼ inch is available, but it will be appreciated by those of skill in the art that additional play may be designed into the parts as needed for a particular application. Additional adjustable clamps may be attached to the underside 20 of the furniture item 12 along clamp recess 16 as necessary.

Figure 5:
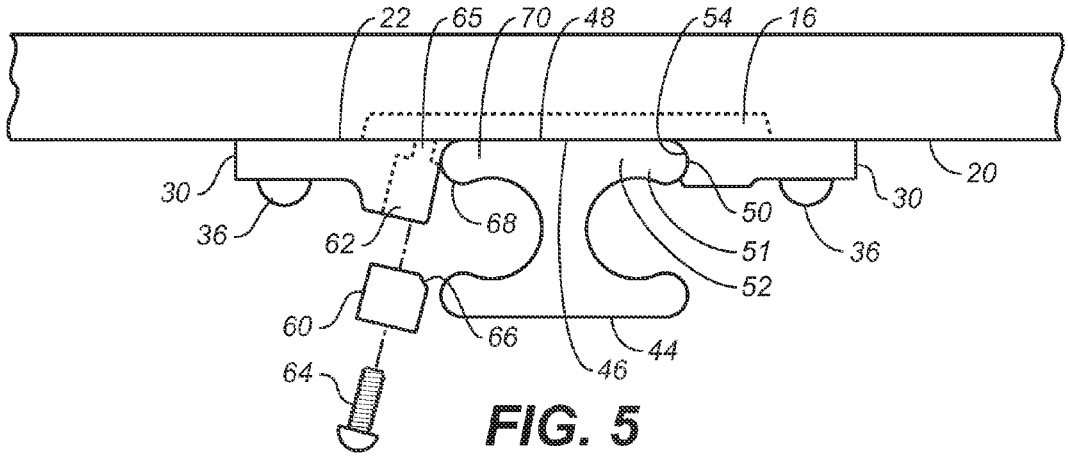
FIG. 5 is an elevational view of the clamp body of the furniture clamp secured to the underside of the furniture item by the arm fasteners, showing the furniture item and clamp body positioned on a support I-beam, and showing a clamp cam and clamp cam fastener in exploded position below the clamp body.

Referring next to FIGS. 5 and 6, after attaching one or more clamp bodies 22 to the underside 20 of the furniture item 12, the assembled furniture item and attached clamp body are laid onto an I-beam 44, that may be extending horizontally from and rigidly affixed to an adjoining wall, until the lower face 46 of the beam pocket 56 of the clamp body 22 rests on the upper beam face 48 of the upper beam flanges 52 of the I-beam 44, and the rounded lateral edge 50 of the right upper beam flange 51 engages the incurved beam capturing surface 54 provided on the inner portion of the right shoulder 23R and which forms the right side of the beam pocket 56 of the clamp body 22. It can be seen that the concave beam capturing surface 54 extends below the outermost edge 58 (see FIG. 6) of the rounded lateral edge 50 of the right upper beam flange 51 so that, as the right upper beam flange 51 is pressed into the beam capturing surface 54, the beam capturing surface 54 cups and captures the right upper beam flange 51. It will be readily understood that, while the beam capturing surface 54 as illustrated has a concave shape, other shapes may be used that perform the function of capturing the right upper beam flange 51. For example, the right upper beam flange 51 and the beam capturing surface 54 could have coordinating square, oval, or hooked shapes.

Left shoulder 23L includes a sloped beam guide face 59 which guides the left upper beam flange 70 into the beam pocket 56 while the right upper beam flange 51 is engaged with the beam capturing surface 54.

When the underside 20 of the furniture item 12 is resting directly on the top surfaces 28 of the clamp body's arms 30, the downwardly oriented lower face 46 of the beam pocket 56 is in planar alignment with the underside 20 as can best be seen in FIG. 5. Therefore, when lower face 46 is resting on the upper beam face 48 of the I-beam 44, the upper beam face 48 is also in planar alignment with the underside 20 of the furniture item 12 which simplifies and facilitates measuring required for positioning the furniture item 12.

With continuing reference to FIGS. 5 and 6, clamp cam 60 is inserted into clamp cam receiving socket 62 in clamp body 22 and held in place by inserting clamp cam fastener 64 through clamp cam fastener bore 63 in clamp cam 60 and tightening clamp cam fastener 64 in clamp cam fastener hole 65. As the clamp cam 60 is inserted into clamp cam receiving socket 62, its cam binding face 66 is brought into contact with the lower portion 68 of the left upper beam flange 70 thereby pinning the upper beam flanges 52 between the clamp cam 60 and the beam capturing surface 54.

Figure 7:
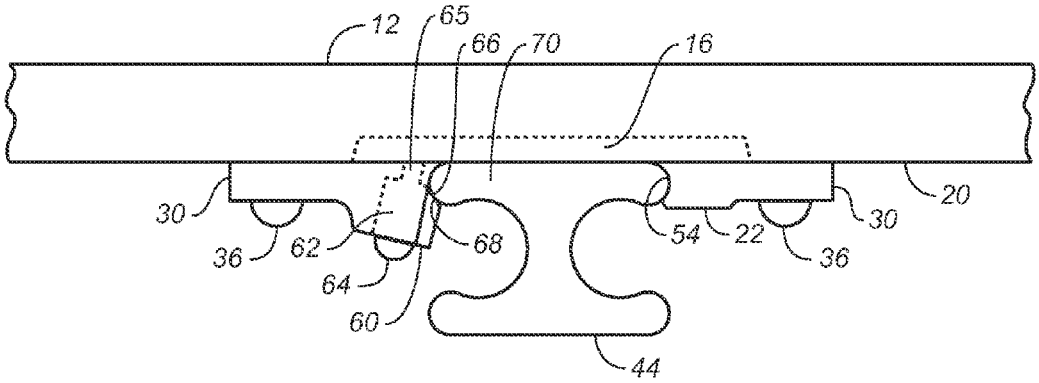
FIG. 7 is an elevational view similar to FIG. 5 showing the clamp cam fastened in position to the underside of the clamp body with the clamp cam fastener.
Figure 8:
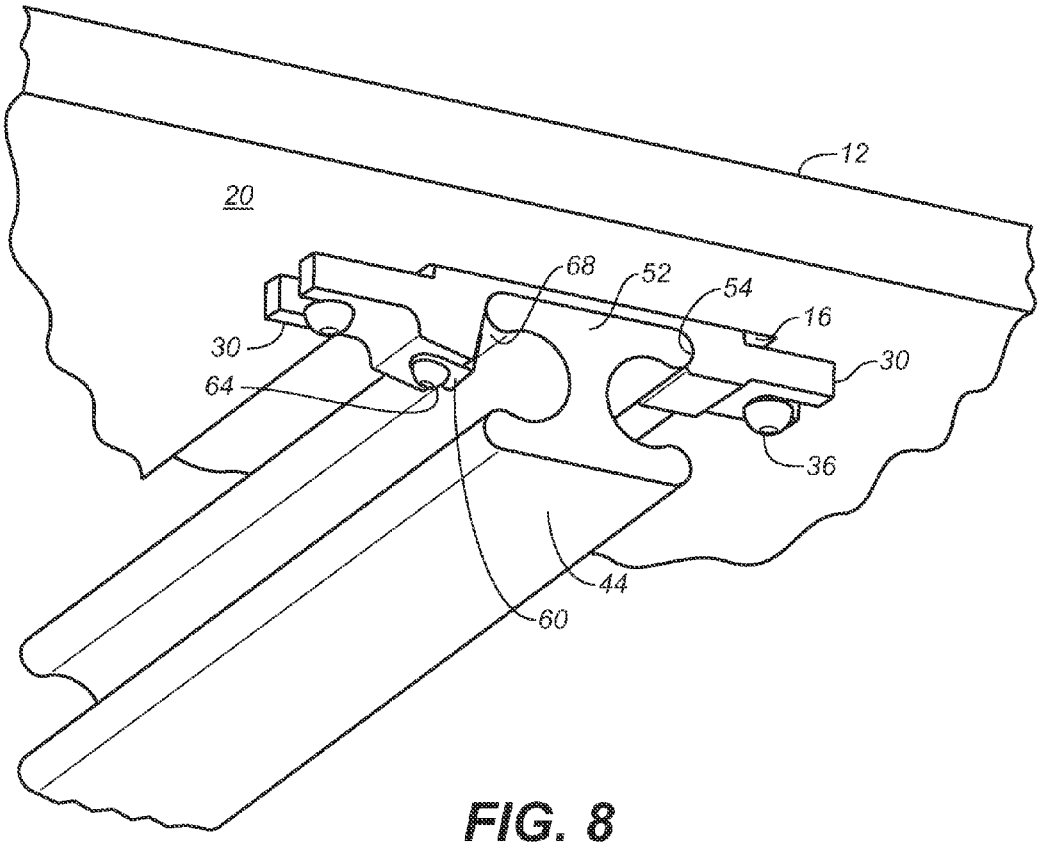
FIG. 8 is a lower perspective view of the furniture item, clamp body, arm fasteners, I-beam, clamp cam and clamp cam fastener assembled as shown in FIG. 7.

In a typical installation, the arm fasteners 36 and the clamp cam fastener 64 are loosely tightened just enough to hold the assembly together. The furniture item 12 is then put in the optimal position relative to the adjoining wall given whatever surface imperfections may be present. Adjustments in position of the furniture item are permitted because of the two directions of play in the clamp body 22 discussed above (and see again FIG. 4), and the ability to move the clamp 22 longitudinally along the I-beam 44. When the furniture item 12, such as a desk, is properly aligned with the wall or other furniture elements, such as a desk return, the arm fasteners 36 are tightened to secure the clamp body 22 to the underside 20 of the furniture item 12 at the desired orientation to the furniture item. It should be noted that this point, the furniture item, with the clamp body 22 attached to it, may be removed from the I-beam if desired and when it is replaced on the I-beam at a later time, the preadjusted clamp body or bodies 22 will automatically adjust the position of the furniture item to the wall. Finally, after the clamp body 22 is secured to the furniture item, the tightening of the clamp cam fastener 64 secures the I-beam 44 in the beam pocket 56 of the clamp body 22 by compression of the clamp cam 60 against the left upper flange 70 of the upper flanges 52 of the I-beam 44 as shown in FIGS. 7 and 8. Although the furniture item is securely attached to the I-beam, it can very quickly be detached simply by loosening the clamp cam fastener 64 and lifting the furniture item 12 and attached clamp body 22 off of the I-beam 44.

An adjustable furniture attachment clamp according to the invention allows for adjustments in position of furniture items having horizontal undersides along a support beam, and permits rapid attachment and detachment of any such furniture item to a supporting I-beam. Adjustable furniture clamps may be used singly or in multiples depending on the size of the work surface to be deployed and the strength of the connection desired.

There have thus been described and illustrated certain preferred embodiments of an adjustable furniture attachment clamp according to the invention. Although the present invention has been described and illustrated in detail, it is clearly understood that the same is by way of illustration and example only and is not to be taken by way of limitation, the spirit and scope of the present invention being limited only by the terms of the appended claims and their legal equivalents.

We claim:

1. An adjustable furniture attachment clamp for attaching furniture items to a wall, the furniture item having a horizontal underside, the underside having a downwardly oriented clamp recess and a pair of arm fastener holes, the clamp recess having a vertical height and opposite side edges defining a horizontal breadth, the arm fastener holes for receiving a pair of arm fasteners, the arm fastener holes separated by distance defining an arm fastener holes separation distance, each of the arm fasteners having a shank including a shank width, the adjustable furniture attachment comprising:

a clamp body having right and left spaced apart shoulders, a horizontal top strut extending between and connecting said shoulders, and a pair of oppositely disposed horizontal arms extending laterally from said shoulders, each of said arms having a top surface and a laterally extending fastener slot having a fastener slot width greater than the shank width of each of the pair of arm fasteners, each of said fastener slots having an inner end, the inner ends of said fastener slots spaced apart by a fastener slot separation distance less than the arm fastener holes separation distance, whereby, when the arm fasteners are inserted through the fastener slots in said arms and the arm fasteners are engaged with and partially tightened in the fastener holes, said arms are loosely secured to the underside of the furniture item, lateral play is provided corresponding to the difference between said fastener slot separation distance and the arm fastener holes separation distance, and forward-to-back play is provided corresponding to the difference between the fastener slot width of each of said fastener slots and the shank width of each of the arm fasteners, thereby enabling positional adjustment of the arms relative to the furniture item before tightening the arm fasteners, and when said arm fasteners are fully tightened in said arm fastener holes said pair of arms are secured to the underside of the furniture item.

2. The adjustable furniture attachment clamp of claim 1 wherein:

said top strut has opposite side walls spaced apart to define a top strut width, said top strut width no greater than the horizontal breadth of the clamp recess.

3. The adjustable furniture attachment clamp of claim 2 wherein:

when said arm fasteners are fully tightened in said fastener holes said top strut is received in the clamp recess.

4. The adjustable furniture attachment clamp of claim 1 wherein:

said top strut includes a top face between said side walls, and said top face is in parallel planar alignment with and vertically spaced above the top surfaces of said arms a distance no more than the height of the clamp recess.

5. The adjustable furniture attachment clamp of claim 1, the adjustable furniture attachment for use in association with a supporting horizontal I-beam, the I-beam having an upper beam face and opposing right and left upper beam flanges, each upper beam flange having an outwardly protruding lateral edge including a downwardly facing lower portion, the adjustable furniture attachment further comprising:

said top strut having a downwardly oriented lower face, the inner edge of the right shoulder including an inwardly facing beam capturing surface having a shape corresponding to the lateral edge of the right upper beam flange of the supporting I-beam, said beam capturing surface for engaging the right upper beam flange, the inner edge of the left shoulder having a sloped beam guide face and a clamp cam fastener hole, said beam guide face having a clamp cam receiving socket, the lower face of said top strut, said beam capturing surface, and said beam guide face defining a beam pocket for receiving the upper beam flanges of the supporting I-beam, said beam guide face for guiding the left upper beam flange into said beam pocket when the right upper beam flange is engaged with said beam capturing surface, a clamp cam having a binding face for engaging the lower portion of the lateral edge of the left upper beam flange, said clamp cam removably inserted in said clamp cam receiving socket, and a clamp cam fastener for tightening said clamp cam to said clamp body, whereby when the upper beam flanges of a supporting I-beam are received in said beam pocket with the right upper beam flange bearing against said beam capturing surface and the upper beam face abutting the lower face of said top strut, tightening said clamp cam fastener presses said clamp cam against the lower portion of the rounded lateral edge of the left upper beam flange thereby urging the upper beam flanges against said the lower face of said top strut and driving the right upper beam flange laterally against said beam capturing surface to firmly retain the upper beam flanges in said beam pocket.

6. The adjustable furniture attachment clamp of claim 5, the outwardly protruding lateral edges of the upper beam flanges have rounded lateral edges, wherein:

the inwardly facing beam flange has a concave shape.

7. The adjustable furniture attachment clamp of claim 5 wherein:

said lower face of said top strut is in planar alignment with the top surfaces of said arms, such that when said arms are secured to the furniture item, said lower face is in planar alignment with the underside of the furniture item.

8. The adjustable furniture attachment clamp of claim 5 wherein:

said beam capturing surface engages the lower portion of the rounded lateral edge of the right upper beam flange.

9. The adjustable furniture attachment clamp of claim 5 wherein:

said inner edge of the left shoulder of said clamp body includes a clamp cam fastener hole, said clamp cam has a clamp cam fastener bore, and said clamp cam fastener is removably disposed in said clamp cam fastener bore and detachably engaged with said clamp cam fastener hole.

10. An adjustable furniture attachment clamp for attaching furniture items to a supporting horizontal I-beam, the I-beam having an upper beam face and opposing right and left upper beam flanges, each upper beam flange having a rounded lateral edge including a downwardly facing lower portion, the furniture item having a horizontal underside including a downwardly oriented clamp recess and a pair of arm fastener holes, the clamp recess having a vertical height and opposite side edges defining a horizontal breadth, the arm fastener holes for receiving a pair of arm fasteners, the arm fastener holes separated by distance defining an arm fastener holes separation distance, each of the arm fasteners having a shank including a shank width, the adjustable furniture attachment comprising:

a clamp body having right and left spaced apart shoulders, a horizontal top strut extending between and connecting said shoulders, said top strut having a downwardly oriented lower face, and a pair of oppositely disposed horizontal arms extending laterally from said shoulders, each of said arms having a top surface and a laterally extending fastener slot including a fastener slot width, said fastener slot width greater than the shank width of each of the pair of arm fasteners, each of said fastener slots having an inner end, the inner ends of said fastener slots spaced apart by a fastener slot separation distance less than the arm fastener holes separation distance, an inner edge of said right shoulder including an inwardly facing beam capturing surface having a concave shape corresponding to the rounded lateral edge of the right upper beam flange of the supporting I-beam, said beam capturing surface for engaging the right upper beam flange, an inner edge of the left shoulder having a sloped beam guide face and a clamp cam fastener hole, said beam guide face having a clamp cam receiving socket, the lower face of said top strut, said beam capturing surface, and said beam guide face defining a beam pocket for receiving the upper beam flanges of the supporting I-beam, said beam guide face for guiding the left upper beam flange into said beam pocket when the right upper beam flange is engaged with said beam capturing surface, a clamp cam having a clamp cam fastener bore and a binding face, said binding face for engaging the lower portion of a rounded lateral edge of the left upper beam flange, said clamp cam removably inserted in said clamp cam receiving socket, and a clamp cam fastener removably disposed in said clamp cam fastener bore and detachably engaged with said clamp cam fastener hole, whereby, when the arm fasteners are inserted through the fastener slots in said arms and the arm fasteners are engaged with and partially tightened in the fastener holes, and the upper beam flanges of a supporting I-beam are received in said beam pocket with the right upper beam flange bearing against said beam capturing surface and the upper beam face abutting the lower face of said top strut, and said clamp cam fastener is partially tightened in said clamp cam fastener hole, said arms are loosely secured to the underside of the furniture item and lateral play is provided corresponding to the difference between said fastener slot separation distance and the arm fastener holes separation distance and forward-to-back play is provided corresponding to the difference between the fastener slot width of each of said fastener slots and the shank width of each of the arm fasteners, thereby enabling positional adjustment of the arms relative to the furniture item before fully tightening the arm and clamp cam fasteners, and when said arm fasteners are fully tightened in said arm fastener holes said pair of arms are secured to the underside of the furniture item, and tightening said clamp cam fastener presses said clamp cam against the lower portion of the rounded lateral edge of the left upper beam flange thereby urging the upper beam flanges against said the lower face of said top strut and driving the right upper beam flange laterally against said beam capturing surface to firmly retain the upper beam flanges in said beam pocket.

11. An adjustable furniture attachment clamp for attaching furniture items to a wall comprising:

a supporting horizontal I-beam that extends from a wall, the I-beam having an upper beam face and opposing right and left upper beam flanges, each upper beam flange having a rounded lateral edge including a downwardly facing lower portion, a pair of arm fasteners, each of the arm fasteners having a shank including a shank width, a furniture item having a horizontal underside including a downwardly oriented clamp recess and a pair of arm fastener holes, said clamp recess having a vertical height and opposite side edges defining a horizontal breadth, said arm fastener holes for receiving said pair of arm fasteners, said arm fastener holes separated by distance defining an arm fastener holes separation distance, a clamp body having right and left spaced apart shoulders, a horizontal top strut extending between and connecting said shoulders, said top strut having a downwardly oriented lower face, a pair of oppositely disposed horizontal arms extending laterally from said shoulders, each of said arms having a top surface and a laterally extending fastener slot including a fastener slot width, said fastener slot width greater than the shank width of each of said pair of arm fasteners, each of said fastener slots having an inner end, the inner ends of said fastener slots spaced apart by a fastener slot separation distance less than said arm fastener holes separation distance, the inner edge of said right shoulder including an inwardly facing beam capturing surface having a concave shape corresponding to the rounded lateral edge of the right upper beam flange of said supporting I-beam, said beam capturing surface for engaging said right upper beam flange, the inner edge of said left shoulder having a sloped beam guide face and a clamp cam fastener hole, said beam guide face having a clamp cam receiving socket, the lower face of said top strut, said beam capturing surface, and said beam guide face defining a beam pocket for receiving the upper beam flanges of said supporting I-beam, said beam guide face for guiding said left upper beam flange into said beam pocket when said right upper beam flange is engaged with said beam capturing surface, a clamp cam having a clamp cam fastener bore and a binding face, said binding face for engaging the lower portion of the rounded lateral edge of said left upper beam flange, said clamp cam removably inserted in said clamp cam receiving socket, and a clamp cam fastener removably disposed in said clamp cam fastener bore and detachably engaged with said clamp cam fastener hole, whereby, when the arm fasteners are inserted through the fastener slots in said arms and the arm fasteners are engaged with and partially tightened in the fastener holes, and the upper beam flanges of said supporting I-beam are received in said beam pocket with the right upper beam flange bearing against said beam capturing surface and the upper beam face abutting the lower face of said top strut, and said clamp cam fastener is partially tightened in said clamp cam fastener hole, said arms are loosely secured to the underside of said furniture item and lateral play is provided corresponding to the difference between said fastener slot separation distance and the arm fastener holes separation distance and forward-to-back play is provided corresponding to the difference between the fastener slot width of each of said fastener slots and the shank width of each of said arm fasteners, thereby enabling positional adjustment of said arms relative to said furniture item before fully tightening said arm and clamp cam fasteners, and when said arm fasteners are fully tightened in said arm fastener holes said pair of arms are secured to the underside of said furniture item, and tightening said clamp cam fastener presses said clamp cam against the lower portion of the rounded lateral edge of the left upper beam flange thereby urging the upper beam flanges against said the lower face of said top strut and driving the right upper beam flange laterally against said beam capturing surface to firmly retain the upper beam flanges in said beam pocket.

* * * * *